US005579626A

United States Patent [19]

Thomas

[11] Patent Number: 5,579,626

[45] Date of Patent: Dec. 3, 1996

[54] CRIMPING TOOL TO SECURE A CAP ONTO A BOTTLE OR VIAL

[75] Inventor: Glenn E. Thomas, Louisville, Ky.

[73] Assignee: Chromatography Research Supplies, Inc., Addison, Ill.

[21] Appl. No.: 426,096

[22] Filed: Apr. 21, 1995

[51] Int. Cl.[6] ..... B65B 07/28

[52] U.S. Cl. ..... 53/331.5; 53/317

[58] Field of Search ..... 53/317, 331.5, 53/363, 353

[56] References Cited

U.S. PATENT DOCUMENTS

| | | | |
|---|---|---|---|
| 1,067,797 | 7/1913 | Chellis | 53/363 |
| 1,834,208 | 12/1931 | Hall | 53/363 |
| 2,415,896 | 2/1947 | Marsh et al. | 81/15 |
| 2,811,001 | 10/1957 | Nyberg | 53/363 |
| 3,158,879 | 12/1964 | Barrett | 53/363 |
| 3,162,002 | 12/1964 | Breer | 53/363 |
| 3,217,519 | 11/1965 | Demler | 72/15 |
| 3,332,211 | 7/1967 | Koll et al. | 53/353 |
| 3,998,032 | 12/1976 | Koebbeman | 53/351 |
| 4,745,729 | 5/1988 | Bethge et al. | 53/331.5 |
| 4,987,722 | 1/1991 | Koebbeman | 53/353 |

FOREIGN PATENT DOCUMENTS

| | | | |
|---|---|---|---|
| 776080 | 6/1957 | United Kingdom | 53/363 |

*Primary Examiner*—John Sipos
*Assistant Examiner*—Gene L. Kim
*Attorney, Agent, or Firm*—Middleton & Reutlinger; James C. Eaves, Jr.; John F. Salazar

[57] ABSTRACT

A crimping tool used to secure a cap onto a bottle or vial. The tool has vertical handles, a crimping action involving combined horizontal movement of a movable handle controlling the vertical movement of the crimper, and an in line screw stop to limit the downward movement of the crimper.

15 Claims, 13 Drawing Sheets

102
116
10
90
96
104
110
160
100
114
42
46
162
36
164
132
130
22
34
138
32
134
140
154
146
150
144
142
62
60
106
50
56
54
86
82
122
70
78
76
70
120
70
70
128

FIG. 4
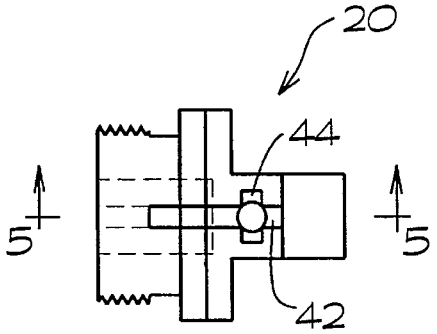
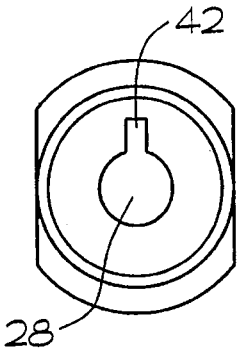
FIG. 6
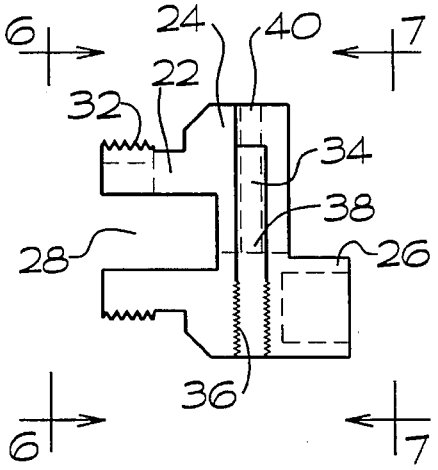
FIG. 5
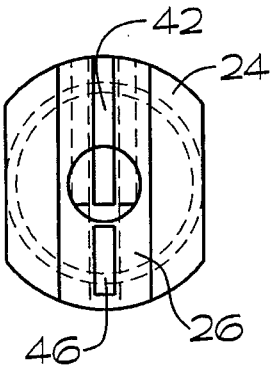
FIG. 7

FIG. 9
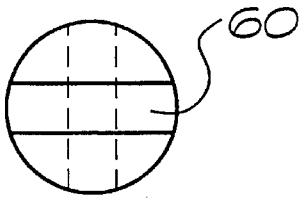
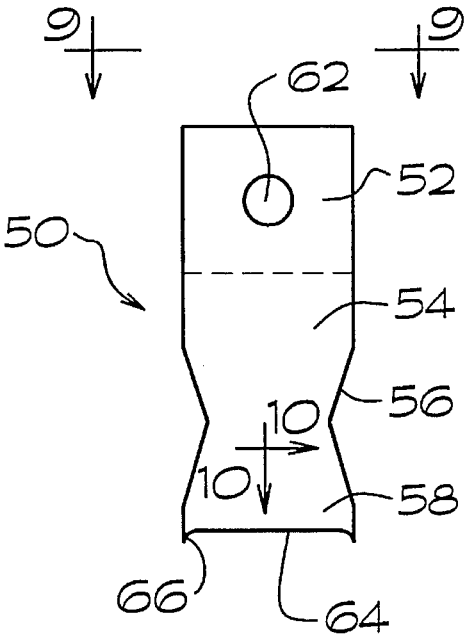
FIG. 8
FIG. 10
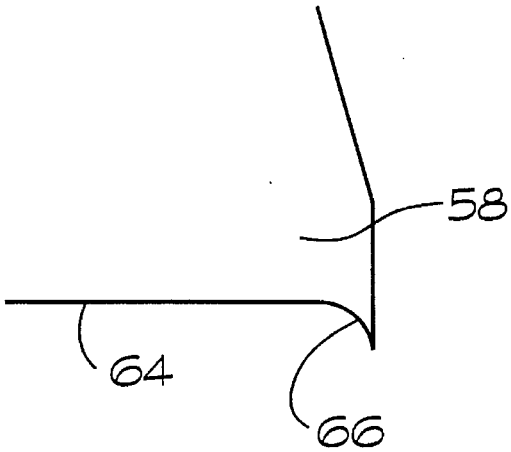

FIG. 12
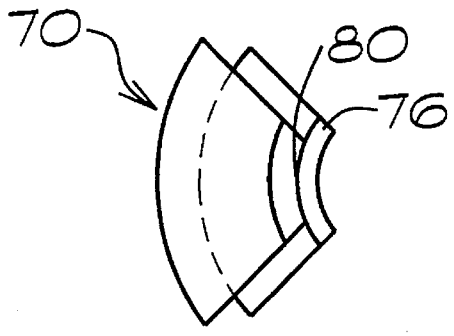
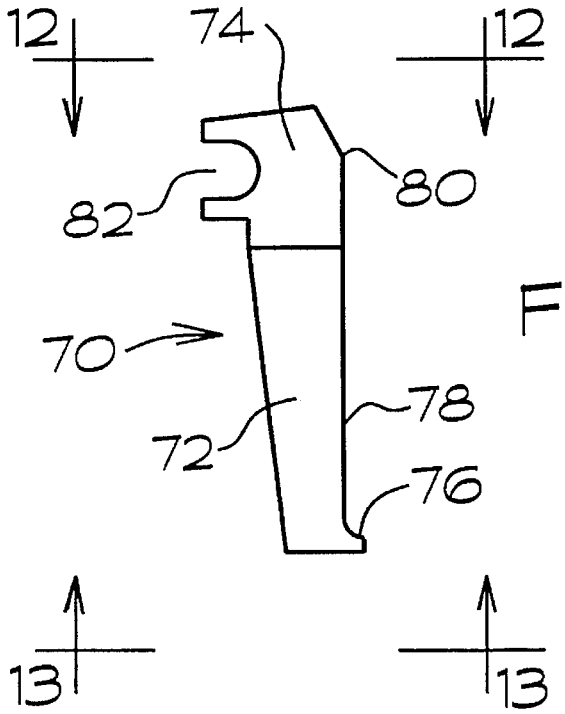
FIG. 11
FIG. 13
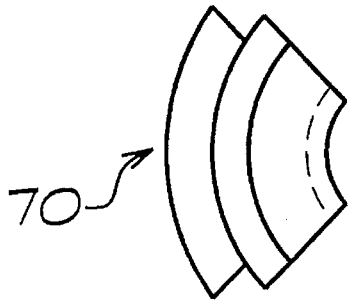

FIG. 15
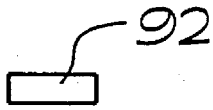
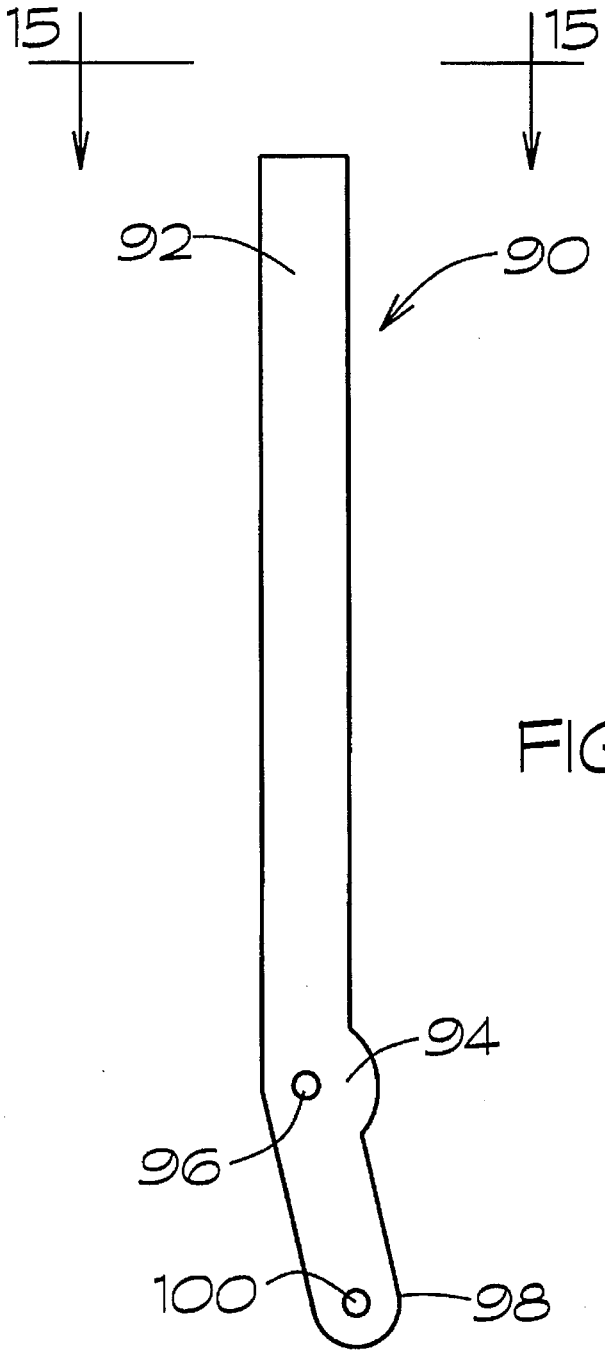
FIG. 14

134
38
132
94
104
44
146
54
56
78

CRIMPING TOOL TO SECURE A CAP ONTO A BOTTLE OR VIAL

BACKGROUND OF THE INVENTION (a) Field of the Invention

The present invention relates to a crimping tool used to secure a cap onto a bottle or vial. The tool has vertical handles, a crimping action involving combined horizontal movement of a movable handle controlling the vertical movement of the crimper, and an in line screw stop to limit the downward movement of the crimper.

(b) Description of the Prior Art

Some bottles or vials to contain liquid samples or other laboratory materials have an opening thereinto which includes a lip onto which a cap is crimped to seal the bottle or vial. In general, for example, the cap can be aluminum or steel, with sample diameters of from about 8 mm to about 22 mm, or greater. Typically the cap has a cylindrical portion which fits over the bottle lip and is then crimped thereunder; the cap has a top with a circular opening therein; the inside of the cap contains a rubber circular portion next to the cap and a Teflon circular portion next to the bottle, although many variations are known. In use, a sample is placed into the bottle or vial and a cap is placed thereon. A crimping tool is then employed to crimp the cap onto the bottle. When a portion of the sample is to be removed, a syringe is inserted through the rubber and Teflon circular portions and the desired amount of the sample is removed.

U.S. Pat. No. 4,987,722, to Koebbeman, teaches a hand-held bottle cap crimper having a pair of horizontal crimping handles, one upper fixed handle and one lower lever handle which moves about a single pivot point to move a crimper, the pivot point being between jaws and the handles so that the tool functions in a see saw fashion.

U.S. Pat. No. 4,745,729, to Bethge et al., teaches a container closing apparatus used to put on a screw cap. U.S. Pat. No. 3,998,032, to Koebbeman, teaches a hand-held bottle cap crimper having a pair of horizontal crimping handles, one lower fixed handle and one upper lever handle which moves about a single pivot point to move a crimper, the jaws being between the pivot point and the handles.

U.S. Pat. No. 3,332,211, to Koll et al., teaches a cap applying apparatus. U.S. Pat. No. 3,217,519, to Demler, teaches a coaxial crimping tool. U.S. Pat. No. 2,415,896, to Marsh et al., a cap applying implement.

SUMMARY OF THE INVENTION

The present invention is for a crimping tool used to secure a cap onto a bottle or vial. The tool has vertical handles, a jaw closing and a crimping action both involving combined horizontal movement of a movable handle controlling the vertical movement of a crimper, and an in line screw stop to limit the downward movement of the crimper.

More particularly, the present invention comprises a crimper head having a fixed vertical handle extending upward therefrom and a movable handle which passes through the crimper head to be attached to a plunger which is partway received into a bore in the crimper head. A horizontal channel in the crimper head controls the movable handle's horizontal movement by controlling the movement of a pin in the movable handle. As the movable handle is moved toward the fixed handle, as limited by the horizontal channel, the plunger attached to the movable handle moves downward toward the curved crimping lips of a plurality of jaws. With the movable handle and fixed handle at the "jaws open" position, a portion of the jaws fits into an hour glass shaped portion of the plunger to permit the jaws to be open. As the movable handle is moved toward the fixed handle, the jaws close and then, as the movable handle is moved even further toward the fixed handle, a cap is crimped onto a vial or bottle. A slide/adjustable limit screw fixes how close the movable handle can be moved toward the fixed handle and, thereby, fixes how far the plunger can be moved toward the curved crimping lip of the jaws.

Preferably, the jaws are retained about the plunger by a circular spring. A wave spring between the jaws and crimper head keeps pressure on the jaws. A shell passes over the jaws and threads onto the crimper head to securely retain the various components of the tool.

Finally, the present invention comprises a crimping tool, having: a crimper head, the crimper head having a lower portion and an opposed upper portion, the lower portion having an upward extending vertical plunger receiving bore thereinto; the crimper head having a movable handle slot therethrough, the movable handle slot extending from the opposed upper portion and intersecting the upward extending vertical plunger receiving bore; the crimper head having a horizontal channel therein, the horizontal channel intersecting the movable handle slot; a plunger, the plunger having a top portion having a generally cylindrical shape and a bottom portion having a generally cylindrical shape, the plunger having a mid portion having a generally hour glass shape; the top portion having a vertical movable handle receiving slot therein and a horizontal bore intersecting the vertical movable handle receiving slot; a fixed vertical handle, the fixed vertical handle being attached to the upper portion of the crimper head; a movable handle having a grip portion, a crimper head interfacing portion, and a plunger interfacing portion; the crimper head interfacing portion being between the grip portion and the plunger interfacing portion; the crimper head interfacing portion having a bore therethrough; the plunger interfacing portion having a bore therethrough; the movable handle being inserted through the crimper head movable handle slot, the plunger interfacing portion being received by the plunger top portion vertical movable handle receiving slot and retained thereby with a first pin, the first pin passing through the plunger horizontal bore intersecting the vertical movable handle receiving slot and the bore in the plunger interfacing portion, the bore in the crimper head interfacing portion having a second pin inserted therein, the second pin being received by the crimper head horizontal channel; a plurality of jaws, each of the plurality of jaws having an upper opening portion and a lower crimping portion with an arcuate plunger slide area therebetween; the upper opening portion having an engagement point for opening; the crimping portion having an inward crimping lip; the plurality of jaws and said plunger being in an abutting relationship; means for opening the plurality of jaws, the opening means circumscribing the plurality of jaws; whereby, as controlled by the second pin being received by the crimper head horizontal channel, when the movable handle and the fixed handle are in a first furthest horizontal spaced relationship, the plunger mid portion having a generally hour glass shape causes the plurality of jaws to be in an open configuration; when the movable handle and the fixed handle are moved from the first horizontal spaced relationship to a second horizontal spaced relationship, the plurality of jaws move from the open configuration to a closed configuration and the plunger moves a first vertical distance toward the inward crimping lips of the plurality of jaws; and, when the movable handle and the fixed handle are moved from the second horizontal spaced relationship to a third closest horizontal spaced relationship, the plunger moves a second vertical distance toward the inward crimping lips of the plurality of jaws.

BRIEF DESCRIPTION OF THE DRAWINGS

A better understanding of the present invention will be had upon reference to the following description in conjunction with the accompanying drawings, wherein:

FIG. 4 shows a side view of the crimper head of the tool of FIGS. 1–3;

FIG. 5 shows a cross section view of the crimper head of FIG. 4 along the lines 5—5 of FIG. 4;

FIG. 6 shows a bottom view of the crimper head of FIG. 5 along the lines 6—6;

FIG. 7 shows a top view of the crimper head of FIG. 5 along the lines 7—7;

FIG. 8 shows a side view of the plunger of the tool of FIGS. 1–3;

FIG. 9 shows a top view of the plunger of FIG. 8 along the lines 9—9;

FIG. 10 shows an expanded view of a selected portion of the plunger of FIG. 8 along the lines 10—10;

FIG. 11 shows a side view of one of the four jaws of the tool of FIGS. 1–3;

FIG. 12 shows a top view of the jaw of FIG. 11 along the lines 12—12;

FIG. 13 shows a bottom view of the jaw of FIG. 11 along the lines 13—13;

FIG. 14 shows a side view of the movable handle of the tool of FIGS. 1–3;

FIG. 15 shows an end view of the movable handle of FIG. 14 along the lines 15—15;

DETAILED DESCRIPTION OF THE PREFERRED EMBODIMENT

Figure 1:
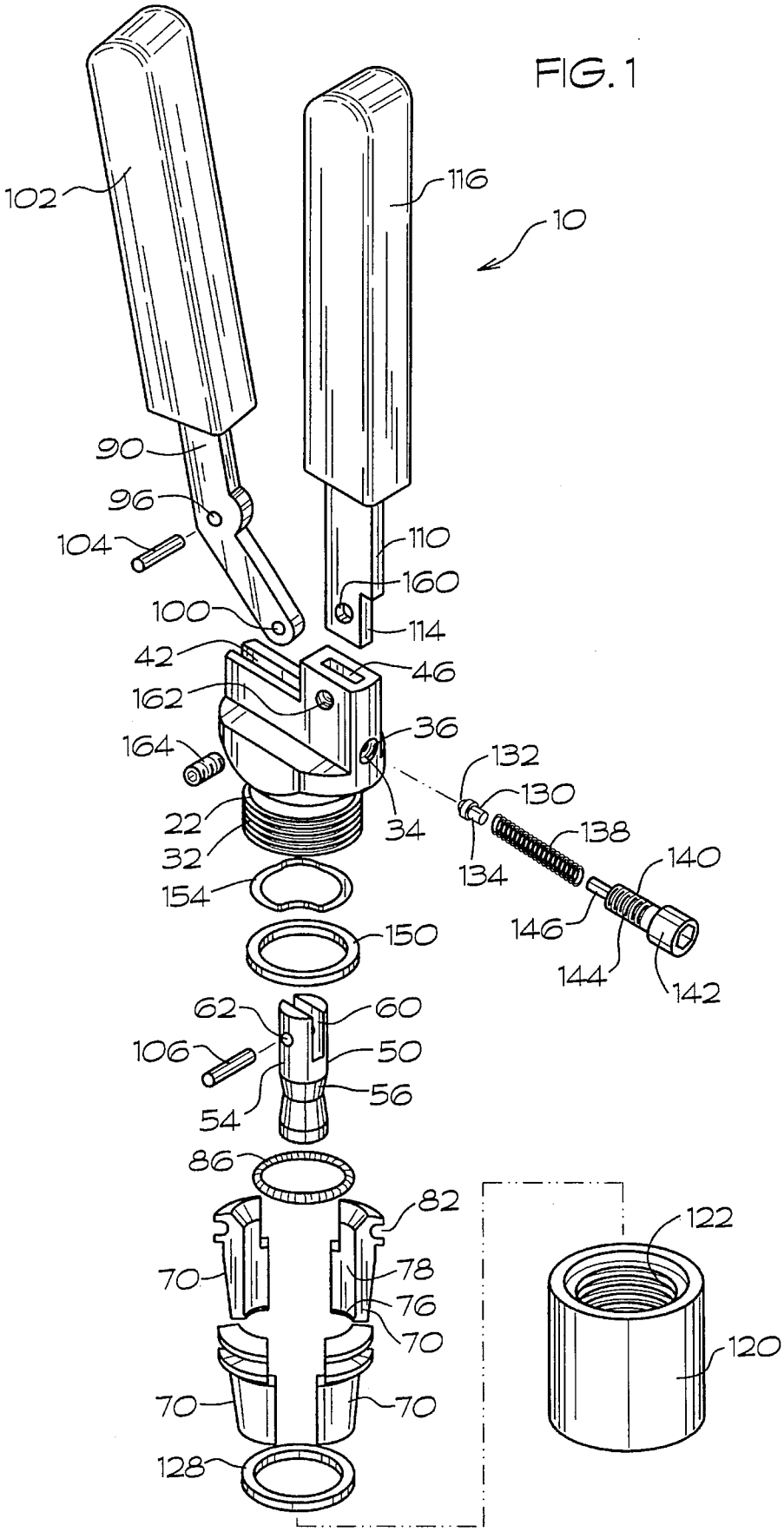
FIG. 1 shows an exploded perspective view of the tool of the present invention.
Figure 2:
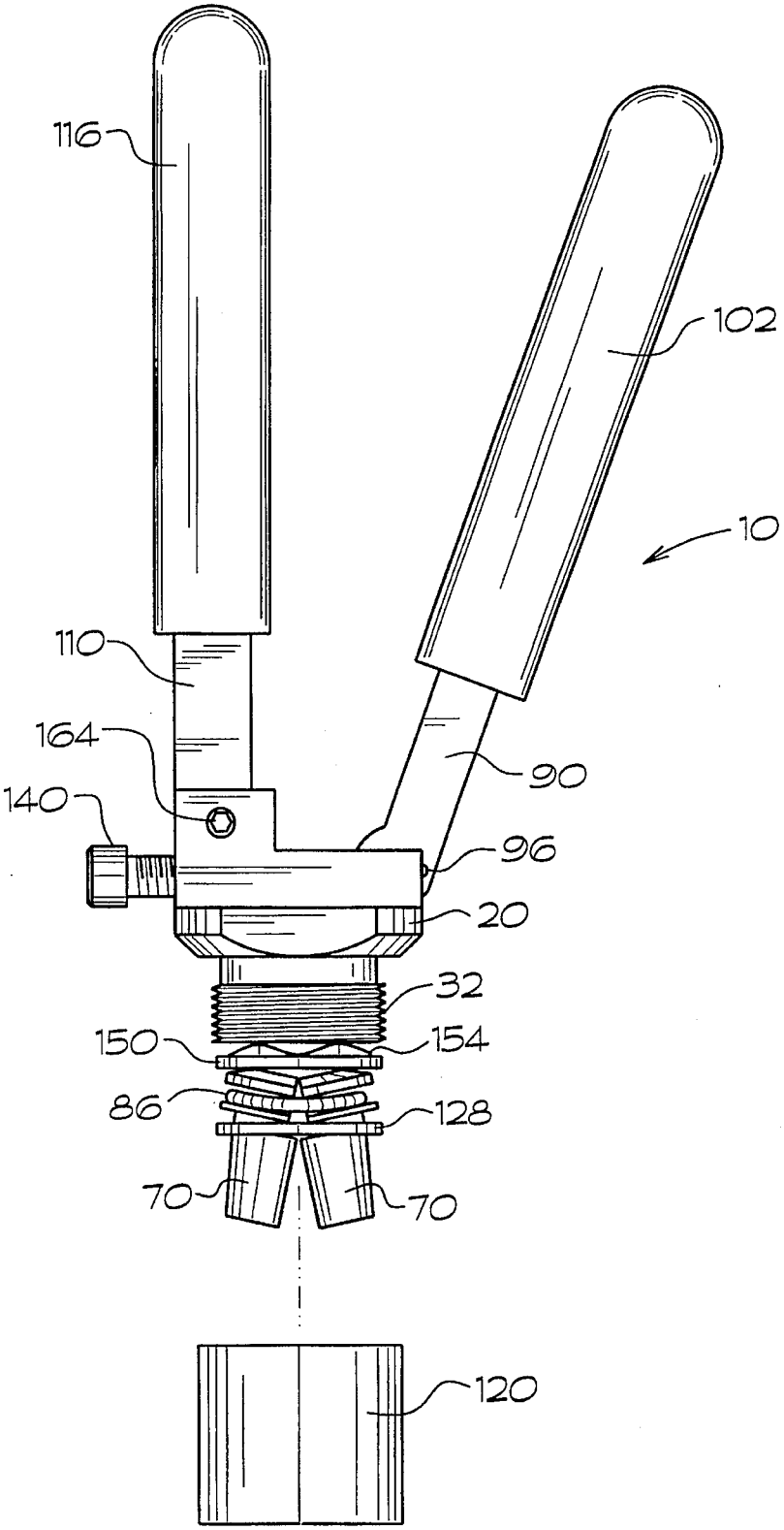
FIG. 2 shows a partially exploded perspective view of the tool of FIG. 1.
Figure 3:
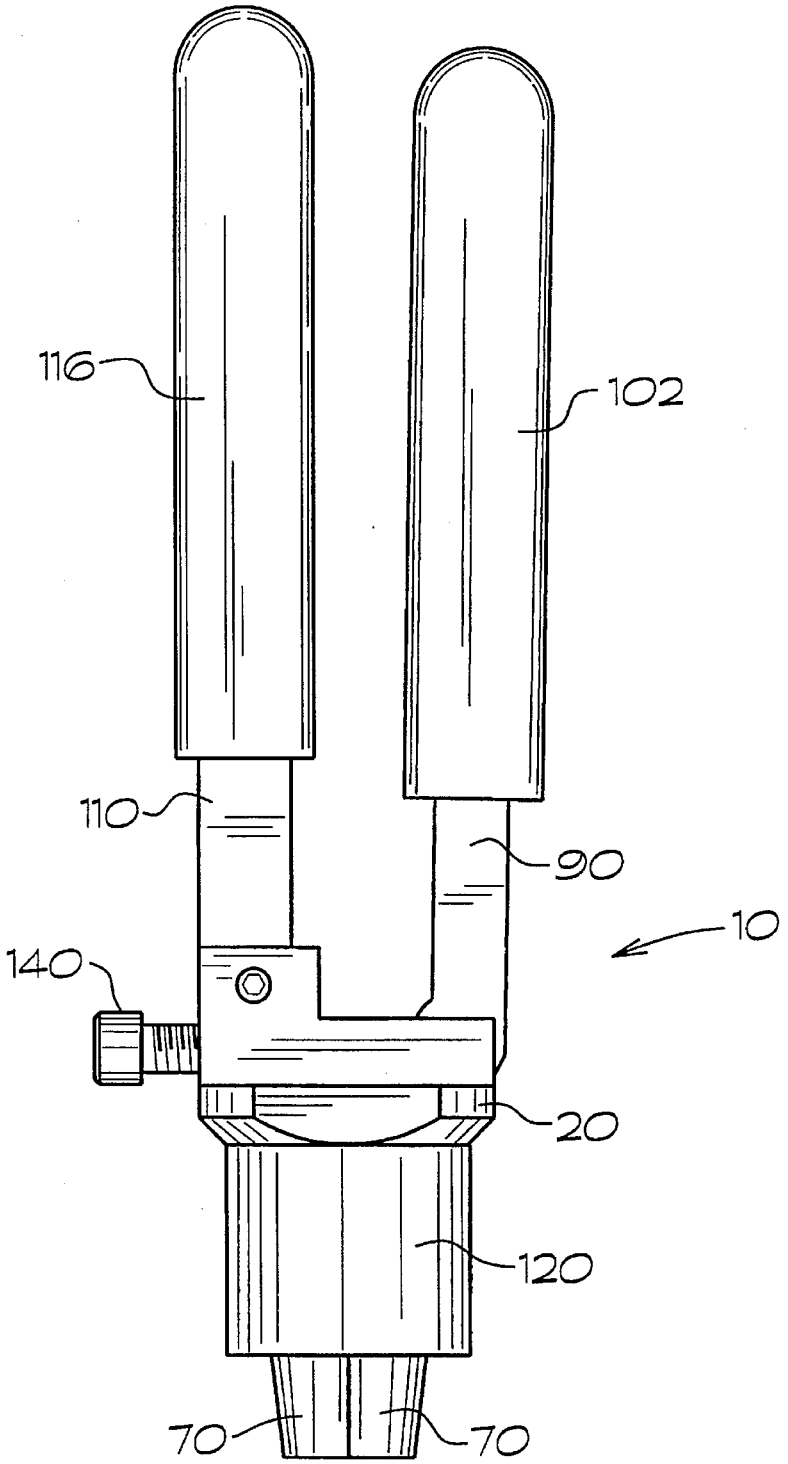
FIG. 3 shows an assembled perspective view of the tool of FIGS. 1 and 2, the tool having the handles in the closed position.

With reference to FIGS. 1–3, the tool 10 of the instant invention is shown having a crimper head 20; a plunger 50 which fits partway into crimper head 20; four jaws 70 circumscribing plunger 50 and retained by circular spring 86; a movable handle 90 which passes through a vertical slot 42 in crimper head 20 and has horizontal movement controlled by a pin 104, handle 90 being received in slot 60 of plunger 50 and attached therein by a pin 106; a fixed vertical handle 110 secured in slot 46 of crimper head 20; a shell 120 having a bushing 128 therein, shell 120 threaded onto crimper head 20 securing bushing 128, jaws 70, spring 86, plunger 50, pin 106, nylon bushing 150, and wave spring 154 therein. Tool 10 also contains means for limiting the distance movable handle 90 can be moved toward fixed vertical handle 110, preferably comprising a slide 130, a spring 138, and a limit adjustment screw 140, all received by a horizontal channel 34 in crimper head 20.

FIGS. 4–7 show crimper head 20 of FIGS. 1–3 in more detail. Crimper head 20 includes a lower body portion 22, a mid body portion 24, and an upper body portion 26. A vertical plunger receiving bore 28 extends from the lower body portion 22 partway toward the upper body portion 26. At least a portion of the external surface of the lower body portion 22 has a threaded portion 32 for threadably receiving shell 120.

The crimper head 20 middle portion 24 includes a horizontal channel 34 having a threaded portion 36, a spring/slide receiving portion 38, and a handle/pin receiving portion 40. A movable handle slot 42 extends vertically from upper body portion 26, intersecting a horizontal pin guide slot 44 of handle/pin receiving portion 40, and further intersecting plunger receiving bore 28. Upper body portion 26 may include a fixed handle slot 46, extending vertically downward into crimper head 20.

FIGS. 8–10 show plunger 50 in detail. Plunger 50 includes a top handle engaging portion 52; a jaw crimping slide portion 54; a jaw opening portion 56, shown having a generally hour glass shape; and a cap engaging head 58. As shown, the hour glass portion of portion 56 toward portion 54 slopes inward at 20° from vertical and the hour glass portion of portion 56 toward portion 58 slopes inward at 15° from vertical.

Top handle engaging portion 52 includes a movable handle receiving slot 60 in a vertical orientation. A horizontal bore 62 passes through top handle engaging portion 52 and intersects slot 60. Cap engaging head 58 includes a center flat surface 64 and an external downward curved surface 66.

FIGS. 1–3 show that four jaws 70 are retained on plunger 50 by circular spring 86. FIGS. 11–13 show one of the jaws 70. Jaw 70 includes a lower crimping portion 72 and an upper opening portion 74. Portion 72 includes a curved crimping lip 76. The inside curved surface of jaw 70 has a plunger slide area 78 shaped such that when the four jaws 70 are placed together the areas 78 are generally cylindrical shaped with a diameter which approximates that of plunger 50. An engagement point for opening 80 permits jaws 70 to open when received by plunger 50's jaw opening portion 56. A generally horizontal groove 82 is provided to receive circular spring 86.

FIGS. 14–15 show movable handle 90. Handle 90 includes a grip portion 92, a portion 94 to interface the crimper head 20 channel 34, and a portion 98 to interface plunger 50. Portion 94 contains a bore 96 and portion 98 contains a bore 100. As shown in FIG. 1, a portion of handle 90 has a plastic coating 102. Also as shown in FIG. 1, movable handle 90 is received into crimper head 20's vertical handle slot 42 and plunger 50's handle receiving slot 60. A pin 106 passes through plunger 50's bore 62 and through movable handle 90's bore 100 to movably connect handle 90 and plunger 50. A pin 104 is inserted into handle 90's bore 96. Pin 104 is received into the horizontal pin guide slot 44 of horizontal channel 34 of crimper head 20. Pin 104 restricts the horizontal movement of handle 90. As will be explained hereinafter, as handle 90 moves horizontally, plunger 50 moves vertically.

Figure 17:
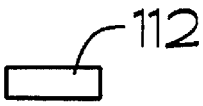
FIG. 17 shows an end view of the fixed vertical handle of FIG. 16 along the lines 17—17.
Figure 16:
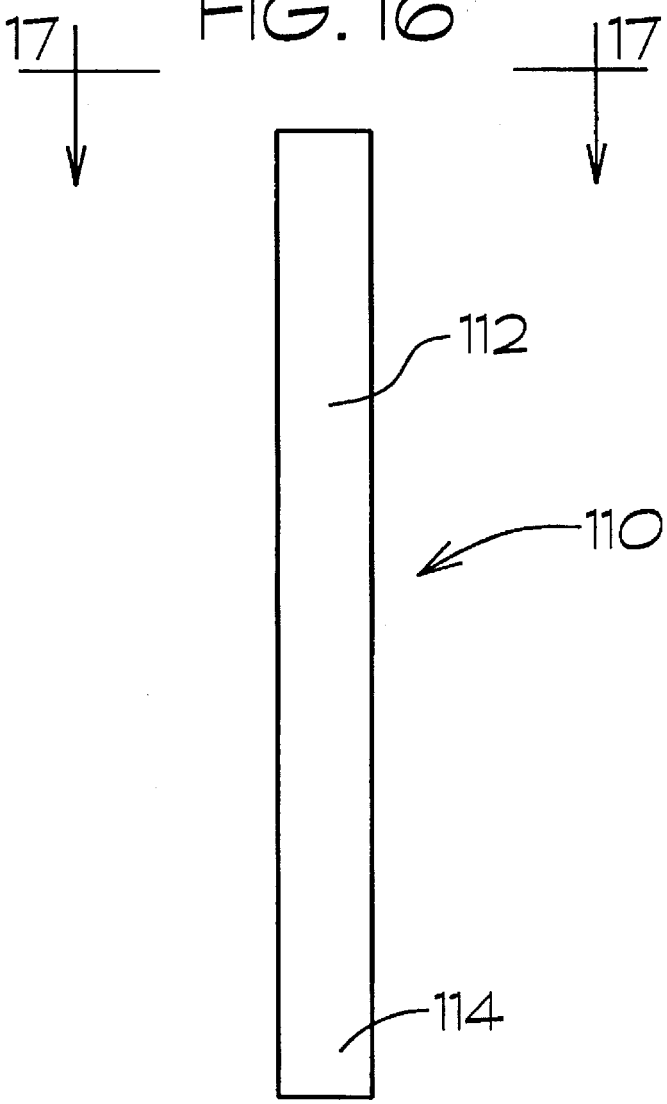
FIG. 16 shows a side view of the fixed vertical handle of the tool of FIGS. 1–3.

FIGS. 16–17 show fixed vertical handle 110 having a grip portion 112 and a portion 114 to interface crimper head 20. With reference to FIG. 1, handle 110 has a portion having a plastic coating 116 thereon. While handle 110 could be of unitary construction with crimper head 20, it is preferable to have a separate handle 110 which is fixedly attached to crimper head 20 by any of several methods known in the art, for example, by glue or set screw. As was taught earlier, upper portion 26 of crimper head 20 includes a fixed handle slot 46. FIG. 1 shows a transverse threaded bore intersecting slot 46 and a bore 160 in fixed handle 110. Fixed handle 110 is placed into slot 46 and threaded set screw 164 is screwed into bore 162 to engage handle bore 160 and secure fixed handle 110 within slot 46.

Figure 19:
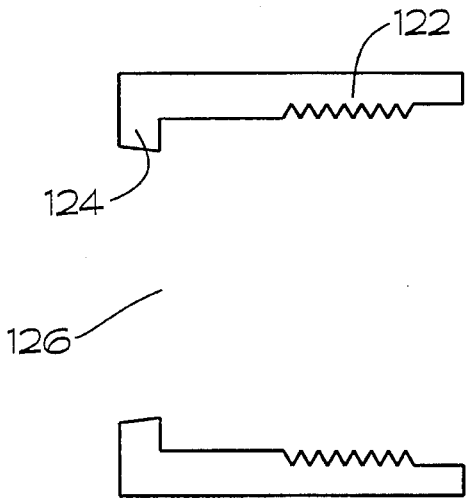
FIG. 19 shows a cross section view of the shell of FIG. 18 along the lines 19—19.
Figure 18:
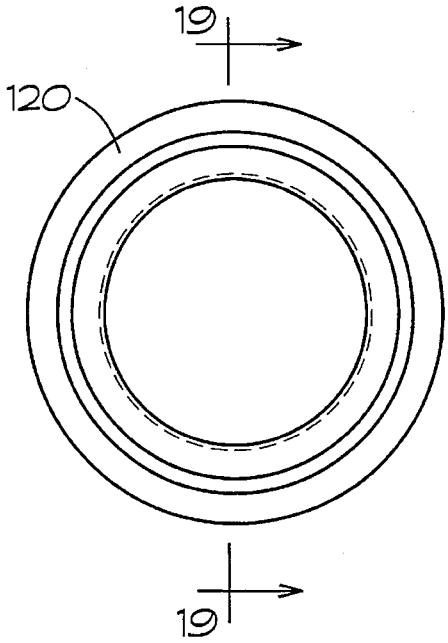
FIG. 18 shows a bottom view of the shell of the tool of FIGS. 1–3.

FIGS. 18–19 show shell 120 having an internal threaded sleeve 122 and a jaw lip and retaining ring 124. As seen in FIGS. 1–2, using circular opening 126, shell 120 fits over the four jaws 70 and threaded sleeve 122 threads onto crimper head 20's threaded portion 32. Preferably, shell 120 is of aluminum. A bushing 128, preferably of steel, is inserted into sleeve to engage shell 120's jaw lip 124. Preferably, jaws 70 have a nylon bushing 150 and a wave spring 154 between them and lower body portion 22 of crimper head 20.

Figure 20:
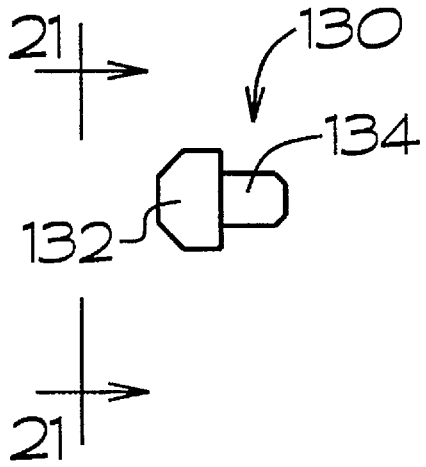
FIG. 20 shows a side view of the slide of the tool of FIGS. 1–3.
Figure 21:
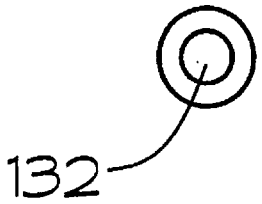
FIG. 21 shows an end view of the slide of FIG. 20 along the lines 21—21.

FIGS. 20–21 show slide 130 having a movable handle engaging portion 132 and a spring receiving portion 134. As seen in FIG. 1, slide 130 has movable handle engaging portion 132 inserted into the threaded portion 36 of horizontal channel 34 of crimper head 20. Spring 138 is inserted likewise to fit over spring receiving portion 134. Limit adjustment screw 140 has a head 142, a threaded portion 144, and a spring receiving portion 146. Threaded portion 144 is threaded into threaded portion 36, portion 146 being inserted into spring 138. Threaded portion 144 is threaded to a desired location to set the limit of how far movable handle 90 can be moved horizontally toward fixed handle 110. This limit adjusts the crimping action as it also sets the lower limit for vertical movement of plunger 50 toward curved crimping lips 76 of jaws 70.

Figure 22:
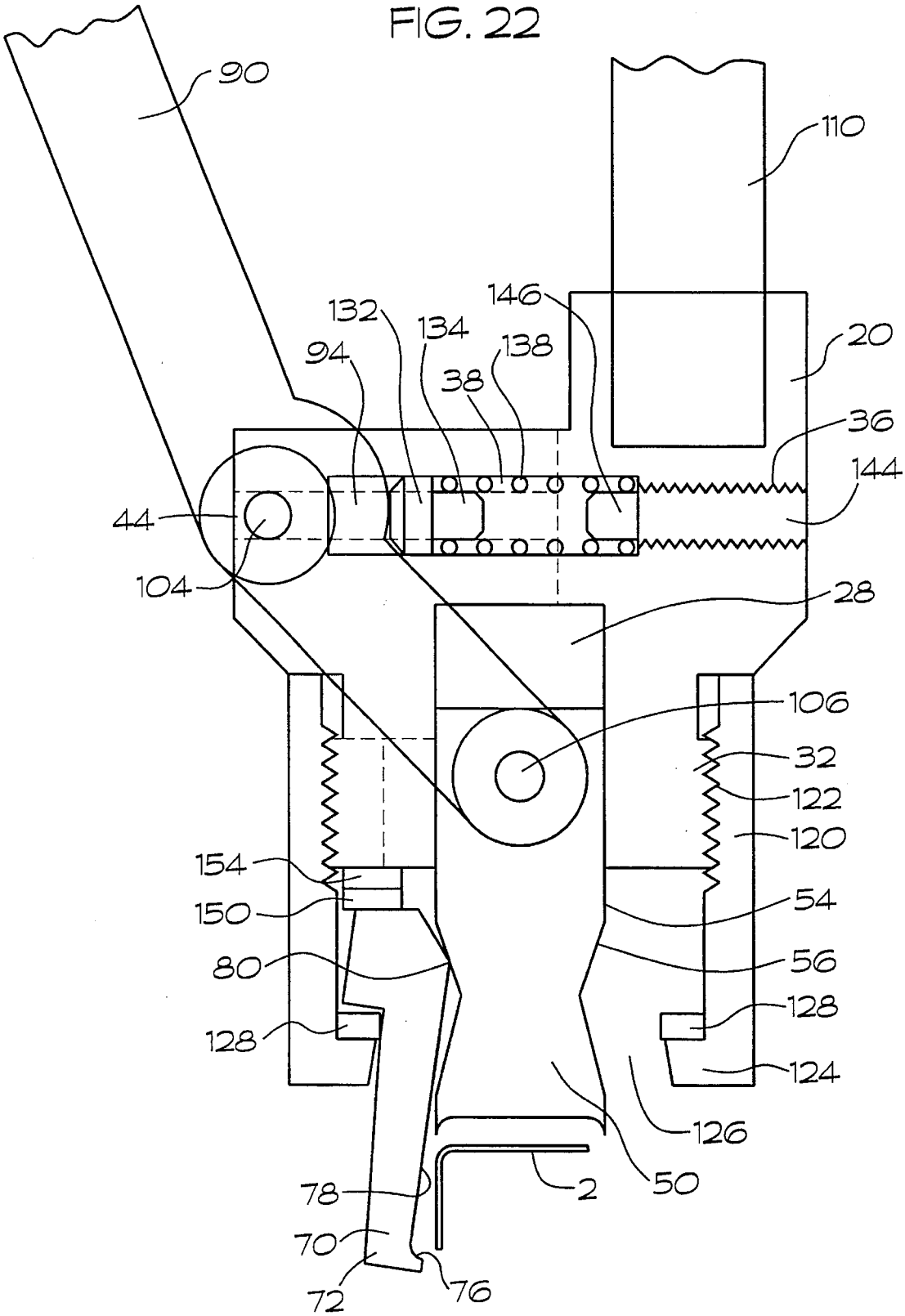
FIG. 22 shows the relative positions of the jaws, plunger, movable handle, and crimper head with the tool of FIGS. 1–3 in an open jaw position to be placed over a bottle with cap to be crimped.
Figure 23:
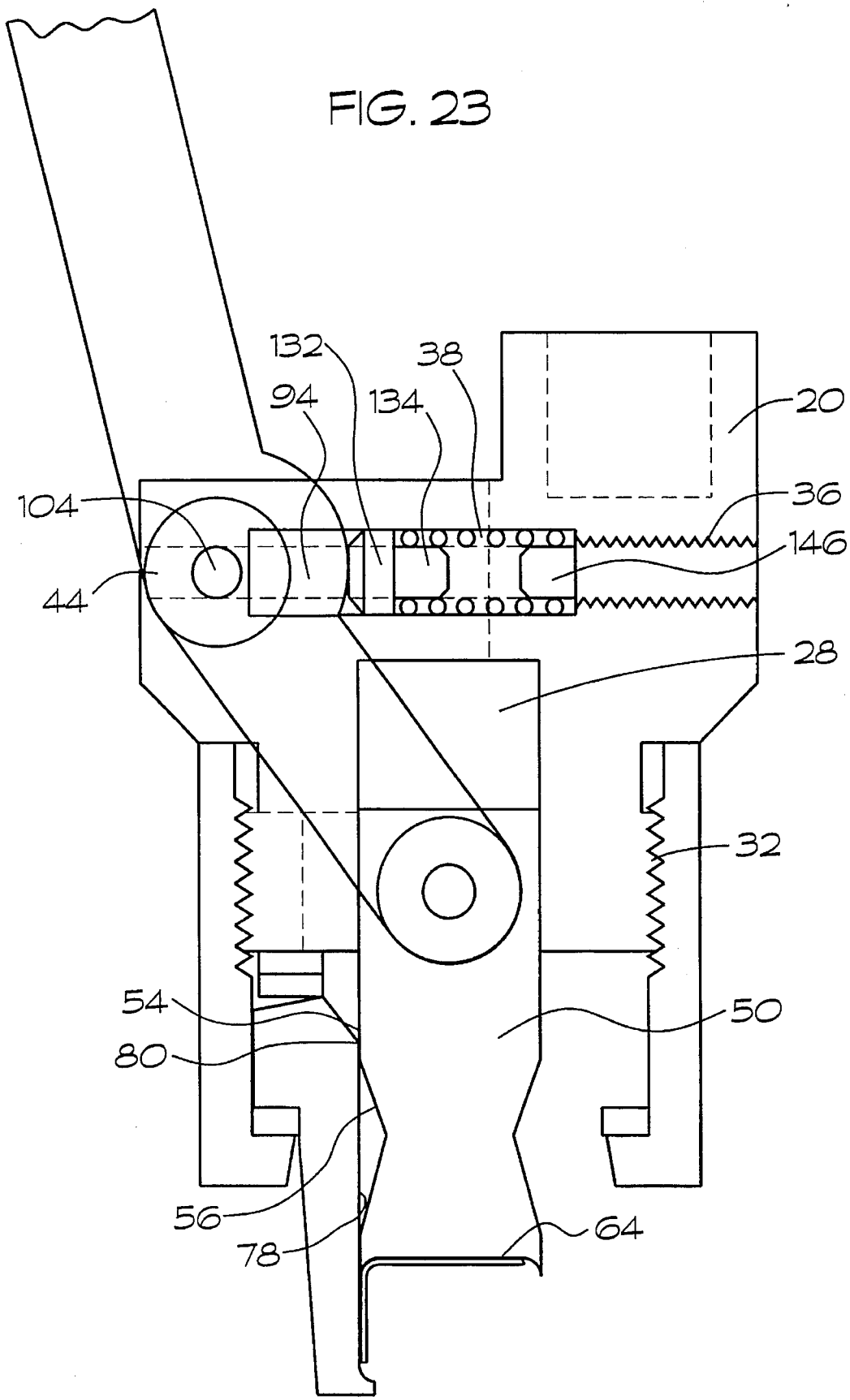
FIG. 23 shows the relative positions of the jaws, plunger, movable handle, and crimper head with the tool of FIGS. 1–3 in a closed jaw position the cap is crimped; and, FIG. 24 shows the relative positions of the jaws, plunger, movable handle, and crimper head with the tool of FIGS. 1–3 in a closed jaw position the cap having been crimped.
Figure 24:
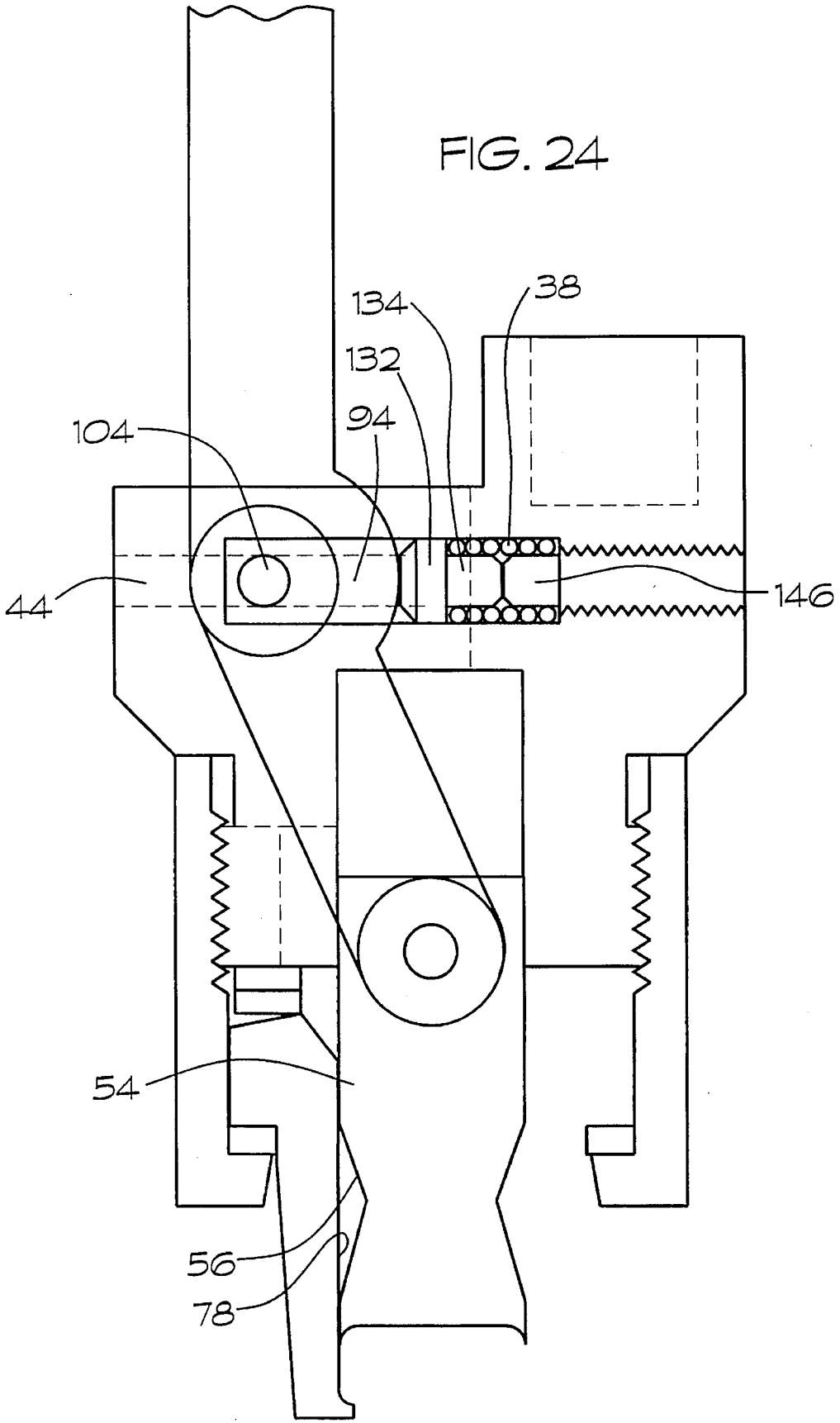

FIGS. 22–24 demonstrate how tool 10 would function to crimp a cap 2 onto a bottle or vial. Portions of the tool have been omitted for clarity, for example, only one jaw 70 is shown. FIG. 22 shows the tool with handles 90/110 at their furthest open position with jaws 70 open, FIG. 23 shows the tool with handles partway together with jaws 70 closed, and FIG. 24 shows the completed crimping action, the tool having handles 90/110 at their closest position as limited by slide 130 and screw 140. As handle 90 is closed toward handle 110, pin 104 moves in horizontal pin guide slot 44 thereby causing movable handle 90's portion 94 to push slide 130 toward limit adjustment screw 140. As seen in FIG. 24, when slide 130's spring receiving portion 132 engages screw 140's spring receiving portion 146, handles 90/110 can not be moved further toward each other.

As shown in FIG. 14, handle 90's portion from 94–98 has about a 26° bend from the portion from 92–94. With the geometry of handle 90, plunger 50, crimper head 20, and jaws 70, FIG. 22 shows that handles 90/110 are at their furtherest spacing and, as permitted by engagement point 80 of jaws 70 and by jaw opening portion 56 of plunger 50, jaws 70 are open to permit the tool to be inserted onto a cap 2 for crimping onto a lip of a bottle or vial, not shown.

As handle 90 is moved toward handle 110, as controlled by pin 104 in guide slot 44, to reach the position of FIG. 23, plunger 50, connected to handle 90 by pin 106, moves toward curved crimping lip 76 of jaws 70. This movement causes the jaws 70 to close with plunger slide area 78 of jaws 70 engaging plunger 50 above and below jaw opening portion 56.

As handle 90 is moved from the position of FIG. 23 to the position of FIG. 24, the crimping action occurs. Because of the geometry of the instant invention, it takes less movement of handle 90 toward handle 110 to close jaws 70 than it does to perform the crimping action. This creates a desirable mechanical advantage for the crimping action over the jaw closing action. For example, as shown, in moving from the position of FIG. 22 to the position of FIG. 23, pin 104 moves horizontally 0.109 inch (2.77 mm) and plunger 50 moves vertically 0.092 inch (2.34 mm); while, in moving from the position of FIG. 23 to the position of FIG. 24, pin 104 moves horizontally 0.176 inch (4.47 mm) and plunger 50 moves vertically 0.108 inch (2.74 mm). This means that the tool user can exert more force in squeezing handle 90 toward handle 110 to crimp the cap onto the vial or bottle. When the user releases his grip on handles 90/110, spring 138 pushes handle 90 back to the jaws open position of FIG. 22.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A crimping tool, comprising:

a. a crimper head, said crimper head having a lower portion and an opposed upper portion, said lower portion having an upward extending vertical plunger receiving bore thereinto; said crimper head having a movable handle slot therethrough, said movable handle slot extending from said opposed upper portion and intersecting said upward extending vertical plunger receiving bore; said crimper head having a horizontal channel therein, said horizontal channel intersecting said movable handle slot;

b. a plunger, said plunger having a top portion having a generally cylindrical shape and a bottom portion having a generally cylindrical shape, said plunger having a mid portion having a generally hour glass shape; said top portion having a vertical movable handle receiving slot therein and a horizontal bore intersecting said vertical movable handle receiving slot;

c. a fixed vertical handle, said fixed vertical handle being attached to said upper portion of said crimper head;

d. a movable handle having a grip portion, a crimper head interfacing portion, and a plunger interfacing portion; said crimper head interfacing portion being between said grip portion and said plunger interfacing portion; said crimper head interfacing portion having a bore therethrough; said plunger interfacing portion having a bore therethrough; said movable handle being inserted through said crimper head movable handle slot, said plunger interfacing portion being received by said plunger top portion vertical movable handle receiving slot and retained thereby with a first pin, said first pin passing through said plunger horizontal bore intersecting said vertical movable handle receiving slot and said bore in said plunger interfacing portion, said bore in said crimper head interfacing portion having a second pin inserted therein, said second pin being received by said crimper head horizontal channel;

e. a plurality of jaws, each of said plurality of jaws having an upper opening portion and a lower crimping portion with an arcuate plunger slide area therebetween; said upper opening portion having an engagement point for opening; said crimping portion having an inward crimping lip; said plurality of jaws and said plunger being in an abutting relationship;

f. means for opening said plurality of jaws, said opening means circumscribing said plurality of jaws;

g. whereby, as controlled by said second pin being received by said crimper head horizontal channel, when said movable handle and said fixed handle are in a first furthest horizontal spaced relationship, said plunger mid portion having a generally hour glass shape causes said plurality of jaws to be in an open configuration; when said movable handle and said fixed handle are moved from said first horizontal spaced relationship to a second horizontal spaced relationship, said plurality of jaws move from said open configuration to a closed configuration and said plunger moves a first vertical distance toward said inward crimping lips of said plurality of jaws; and, when said movable handle and said fixed handle are moved from said second horizontal spaced relationship to a third closest horizontal spaced relationship, said plunger moves a second vertical distance toward said inward crimping lips of said plurality of jaws.

2. The crimping tool of claim 1, where said a first distance is defined between said first and said second horizontal spaced relationships and a second distance is defined between said second and said third horizontal spaced relationships, said first distance having a value less than said second value.

3. The crimping tool of claim 1, where said opening means comprises a circular spring.

4. The crimping tool of claim 1, where said plurality of jaws comprises four jaws.

5. The crimping tool of claim 1, further comprising: means for adjusting said third closest horizontal spaced relationship.

6. The crimping tool of claim 5, where said horizontal channel therein said crimper head has a threaded opening, said threaded opening being opposed to said movable handle slot, said adjusting means comprising a slide, a spring, and a limit adjustment screw, said slide having a movable handle engaging portion and an opposed spring receiving portion, said spring being a coiled spring having opposed ends, said limit adjustment screw having a spring receiving portion, an opposed head, and a threaded portion therebetween; said movable handle engaging portion of said slide being firstly received into said threaded opening to engage said movable handle, said spring being secondly received into said threaded opening, said limit adjustment screw being threadably received by said threaded opening, said spring receiving portion of said slide and said spring receiving portion of said limit adjustment screw being received by said opposed ends of said spring.

7. The crimping tool of claim 1, further comprising a shell, said shell having an internal threaded sleeve of a first diameter, said shell having jaw lip having a second diameter, said second diameter having a value less than said first diameter, said shell having a hollow therethrough; where said crimper head includes an external threaded portion; and, where said shell hollow is received over said plurality of jaws, said shell internal threaded sleeve being threadably received by said crimper head external threaded portion.

8. A crimping tool for crimping caps onto vials, comprising:

a crimping head having a plunger receiving bore centrally aligned therein, a threaded portion circumscribing said bore, a fixed handle slot and a movable handle slot;

a fixed position handle fixedly inserted into said fixed handle slot of said crimping head and extending vertically therefrom;

a movable handle having one distal end inserted within said plunger receiving bore, said movable handle horizontally slidable within said movable handle slot of said crimping head;

a plunger reciprocally movable within said plunger receiving bore and rotatably affixed to said distal end of said movable handle;

a shell threadably received upon said threaded portion of said crimping head;

a plurality of jaws retained between said shell and said plunger and extending downward therefrom, said jaws having crimping means; and wherein said plunger has means comprising an inwardly extending jaw opening portion and a crimping portion formed along its exterior surface and means for allowing said jaws to close and then to force said plunger downward against said cap to force said cap against said closed crimping means upon moving said movable handle to said fixed position handle.

9. The crimping tool of claim 8 wherein said crimping head further comprises a push slide horizontally movable by said movable handle and located within said movable handle slot and a limit adjusting screw extending outward from said movable handle slot limiting the horizontal movement of said push slide.

10. The crimping tool of claim 9 wherein said push slide and said limit adjusting screw have a spring located therebetween thereby forcing said movable handle outward from said fixed position handle.

11. The crimping tool of claim 8 wherein each of said plurality of jaws further comprises an engagement point slidably engagable against said jaw opening portion of said plunger and having inwardly extending crimping lips.

12. The crimping tool of claim 8 wherein said crimping head has an inwardly extending jaw opening portion which extends inwardly about 20 degrees from vertical.

13. The crimping tool of claim 8 wherein said plurality of jaws are compressed inwardly against said plunger by a circular spring circumscribing said jaws.

14. The crimping tool of claim 8 wherein said plurality of jaws further comprises four jaws in side-by-side circular relationship.

15. The crimping tool of claim 8 wherein said movable handle slot of said crimping head is further comprised of a horizontal guide slot transverse to said movable handle slot and which receives the distal ends of a pin inserted through said movable handle, said movable handle horizontally slidable within said horizontal guide slot of said crimping head.

* * * * *